US005116478A

United States Patent [19]

Tate et al.

[11] Patent Number: 5,116,478

[45] Date of Patent: May 26, 1992

[54] EXTENDABLE AND HEAT SHRINKABLE POLYESTER MONO-FILAMENT FOR ENDLESS FABRIC

[75] Inventors: Takuo Tate; Taketoshi Watanabe; Hiroyuki Nagura, all of Tokyo, Japan

[73] Assignee: Nippon Filcon Co., Ltd., Tokyo, Japan

[21] Appl. No.: 669,442

[22] Filed: Mar. 13, 1991

Related U.S. Application Data

[63] Continuation-in-part of Ser. No. 608,756, Nov. 5, 1990, abandoned.

[51] Int. Cl.[5] ..... D21F 3/00

[52] U.S. Cl. ..... 162/358; 139/383 A; 428/225; 428/229; 428/257; 428/258; 428/259; 528/272; 162/DIG. 1

[58] Field of Search ..... 528/272; 139/383; 428/225, 229, 257, 258, 259; 162/DIG. 1, 358

[56] References Cited

U.S. PATENT DOCUMENTS

| | | | |
|---|---|---|---|
| 4,826,949 | 5/1989 | Stanko | 528/272 |
| 4,851,508 | 7/1989 | Kurita et al. | 528/272 |
| 4,929,698 | 5/1990 | Hagewood | 528/272 |

*Primary Examiner*—James J. Bell

*Attorney, Agent, or Firm*—Beveridge, DeGrandi & Weilacher

[57] ABSTRACT

A novel extendable and heat shrinkable polyester monofilament suitable for producing an endless fabric which deforms plastically in the loading range of 0.5 g/d–2.5 g/d and has an extension at the yield point in the range of 1–10%.

12 Claims, 5 Drawing Sheets

EXTENDABLE AND HEAT SHRINKABLE POLYESTER MONO-FILAMENT FOR ENDLESS FABRIC

REFERENCE TO A RELATED APPLICATION

This is a continuation-in-part of our copending application Ser. No. 07/608,756 filed Nov. 5, 1990 now abandoned which is relied on and incorporated herein by reference.

BACKGROUND OF THE INVENTION

The present invention relates to a polyester monofilament for making endless fabrics and to wear-resistant endless fabrics having arranged therein a polyester monofilament. In particular, the present invention relates to a wear-resistant paper making fabric.

Conventional endless fabrics include many fabrics used for such purposes as a belt conveyor, a dehydration conveyer, a filtration fabric, a power transmitting belt, a dryer canvas for paper making, a felt for paper making or a fabric for paper making. All of these endless fabrics have problems in that they extend in the warp direction and shrink in the weft direction. That is, the fabrics draw up in length while shrinking in width because of the strong tensile force in the warp direction exerted in actual use. Further, the fabrics known in the art are poor in attitude stability because they also draw up in length while shrinking in width with loading in the vertical direction. Furthermore, they also have a problem in that they are required to have a large resistance to wear because they are worn away by contact with the driving rolls or controlling rolls of the machinery during running. They are also required to have a smooth running surface for smooth running and a flat upper surface for carrying something on the fabric. These problems are common to endless fabrics, however, satisfactory countermeasures have not hitherto been found for solving the problems. The present invention has successfully solved these problems.

The aforementioned requirements are especially important for making endless fabrics for the paper making industry. Fabrics for paper making are also required to have properties to be described hereinafter which are unique to paper making in addition to the aforementioned properties. The description of the common problems described above referring to fabrics for paper making will clarify problems common to most endless fabrics and solutions to the problems. Thus, the present invention is described with reference to fabrics for paper making as a typical example.

There have hitherto been set out many requirements in addition to the aforementioned problems for fabrics for paper making. These problems are roughly classified into:

(a) problems relating to the quality of paper for its own sake such as the prevention of wire marks or satisfactory intertwinement of paper fibers or problems of yields in paper making;

(b) the improvement of the resistance to wear or the extension of the working life of a fabric;

(c) problems of good water drainage property.

These problems relate to each other in many points; i.e., the problems of: (a) being closely related to the structure of the paper making surface of the fabric, (b) being related to the structure of the running surface of the fabric, and (c) being related to the whole fabric.

There have hitherto been proposed many solutions to problem (a). Nevertheless, there have not been investigations sufficient to avoid problem (b), that is, the improvement of the resistance to wear of fabrics for paper making; the only exception being of preventing the warp from excessive wear by making the paper making fabric with a running side of the weft wearing type. In recent years, there have been increased requirements such as the increase in the rate of paper making, the increase of the amount of loading fillers or the increasing necessity of producing neutral paper, and thus the resistance to wear of the fabric for paper making becomes an issue.

In general, endless fabrics including fabrics for paper making desirably have the wear resistant weft on the running surface taking into consideration the attitude stability of the fabric in use and the extension of its working life. This is because the wearing of the warp causes a change in the size of the fabric and finally the break of the warp which further causes the direct break of the fabric itself, so that a paper making fabric of a warp wearing type has a short working life.

For the purpose of improving the resistance to wear, a polyamide yarn having resistance to wear has been conventionally employed. However, such an attempt did not change the substantial structure of the fabric but only utilized the properties of a material to be used, and thus any epoch-making advantageous effects could not be expected from the fabric. On the other hand, a disadvantage of poor attitude stability was found in fabrics for paper making composed of a polyamide yarn.

Therefore, paper making fabrics which were less extendable and excellent in attitude stability were conventionally constructed by using a polyester yarn having an excellent rigidity as either a warp and a weft.

Also, in such conventionally used fabrics for paper making, a yarn having a large diameter was used as a weft on the running side of the fabrics for paper making in order to satisfy the aforementioned requirements. Such an attempt was successful to a certain extent in the improvement in the resistance to wear. However, such an attempt led to an imbalance between the weft and the warp because of the larger diameter of the weft. Thus, too many disadvantages were present to be used in practice such as the deterioration of the crimping ability or the appearance of wire marks.

Furthermore, as is understood from the aforementioned problem (c), the water drainage property is also affected by the change of the structure of a fabric, and problems will not be solved by such temporary means as using a large diameter yarn.

In view of such conventional technical problems, the present inventors have invented a special, extendable and heat shrinkable polyester monofilament which is excellent in resistance to wear, attitude stability and surface smoothness effect for the construction of an endless fabric; improved the structure of an endless fabric for paper making with use of the filament to improve the resistance to wear; and also improved the performance in making paper with respect to the water drainage property and the wire-marking property.

SUMMARY OF THE INVENTION

In its broadest aspects, the present invention relates to extendable and heat shrinkable polyester monofilament for making an endless fabric especially suited for use in the paper making industry The monofilament is characterized by a number of features. Thus, the filament deforms plastically in the loading range of 0.5 g/d-2.5 g/d on applying a load, for example, at a rate of 2 mm/min. It has an extension at the yield point in the range of 1-10%. In addition, the novel filament of the invention has a heat shrinkage factor of 7% or more on immersing the monofilament into boiling water.

Another aspect of the invention relates to an endless fabric, wherein the extendable heat shrinkable polyester monofilament as described above is arranged at least as a weft. The endless fabric of the invention is well suited for use as a wear-resistant paper making fabric.

In another aspect of the invention, there is provided an endless multiple weft-layer fabric having wefts arranged in the multiple layers of upper and lower layers, wherein the extendable heat shrinkable polyester monofilament as defined above is arranged at least as a weft of said endless multiple weft-layer fabric.

Thus, the wear-resistant multiple weft-layer fabric for paper making of the invention has wefts arranged in the multiple layers of the upper paper making surface and the lower running surface, wherein the extendable heat shrinkable polyester monofilament as described herein is arranged at least as a weft of the fabric. Particularly important is where the extendable heat shrinkable polyester monofilament is arranged at least as a weft on the running surface of the fabric.

Contemplated within the scope of the invention are wear-resistant multiple weft layer fabrics for paper making having wefts arranged in the multiple layers of the upper paper making surface and the lower running surface, wherein a combination of a conventional polyester monofilament and/or a polyamide monofilament is used and the extendable and heat shrinkable polyester monofilament is arranged at least as a weft of the fabric; especially on the running surface of the fabric.

The most important one of various factors for obtaining a paper making fabric exhibiting the aforementioned properties is the filament which constitutes the fabric. While the material of the filament itself has a large influence, physical properties possessed by the filament as a result of its treatment also have large effects. The filament for constituting the paper making fabric is preferably a synthetic resin filament in view of its known resistance to wear and the rigidity.

The weft and warp made of conventional synthetic monofilaments are bent or deformed by the weaving force during weaving into a fabric, but the monofilaments tend to return to their original linear shape as soon as the force is removed because such bending is merely elastic deformation but not plastic deformation.

The extendable heat shrinkable polyester monofilament according to the present invention has properties quite different from such conventional monofilaments. That is, the extendable heat shrinkable polyester monofilament according to the present invention is a very special filament which has a yield point, a plastic deformability and a large heat shrinkability. In other words, it is a novel monofilament which has hitherto been unknown and has special properties such as a plastic deformation at a loading in the range of 0.5-2.5 g per denier (referred to hereinafter as g/d), an extension of 1-10% at the yield point and a heat shrinkability of 7% or more on immersion into boiling water.

The aforementioned special, extendable and heat shrinkable polyester monofilament according to the present invention can be prepared by controlling the extendability, relaxation and treatment temperature of a filament to afford it the aforementioned extension and a large heat shrinkability. The aforementioned special, extendable heat shrinkable polyester monofilament according to the present invention has an excellent attitude stability and surface smoothness imparting effect on the fabric. Also, the paper making fabric according to the present invention has an improved structure by the use of the aforementioned special, extendable and heat shrinkable polyester monofilament, so that the paper making ability of the paper making surface is improved. The water drainage ability and wire marking property of the fabric are also substantially improved. As a result, the quality of paper to be made is improved.

The polyester monofilament of the present invention is described below:

A. Method of making polyester.

Excess ethylene glycol is reacted with dimethyl terephthalate according to the following equation:

$$2HOCH_2CH_2OH + CH_3OCOC_6H_4COOCH_3 \xrightarrow[\text{catalyst}]{200^\circ}$$

$$HOCH_2CH_2OCOC_6H_4COOCH_2CH_2OH + 2CH_3OH$$

(BHT)

B. The chemical structure of polyester is represented by the formula:

$$H(OCH_2CH_2OCOC_6H_4CO)_nOH_3$$

wherein n in the formula stands for polymerization degree. The degree of polymerization is between 100 to 190 and the molecular weight of the polyester is 19200-36480.

C. Method of manufacturing polyester monofilament:

(1) According to known melting yarn making techniques, the filament is extruded from the conventional yarn making nozzle.

(2) Then the yarn is stretched at 80° to 100° C. to a stretch degree of 2 to 4.

(3) The resulting monofilament, after heat setting if desired, has the physical characteristics described herein. Heat setting is not necessary in the case where the resulting monofilament already has the physical characteristics described. In other words, the physical characteristics of monofilament vary in accordance with degree of polymerization for polyester, yarn making conditions, stretching degree, stretching temperature, and so on. Therefore, heat setting can be carried out if necesssary.

DETAILED DESCRIPTION OF INVENTION

Figure 1:
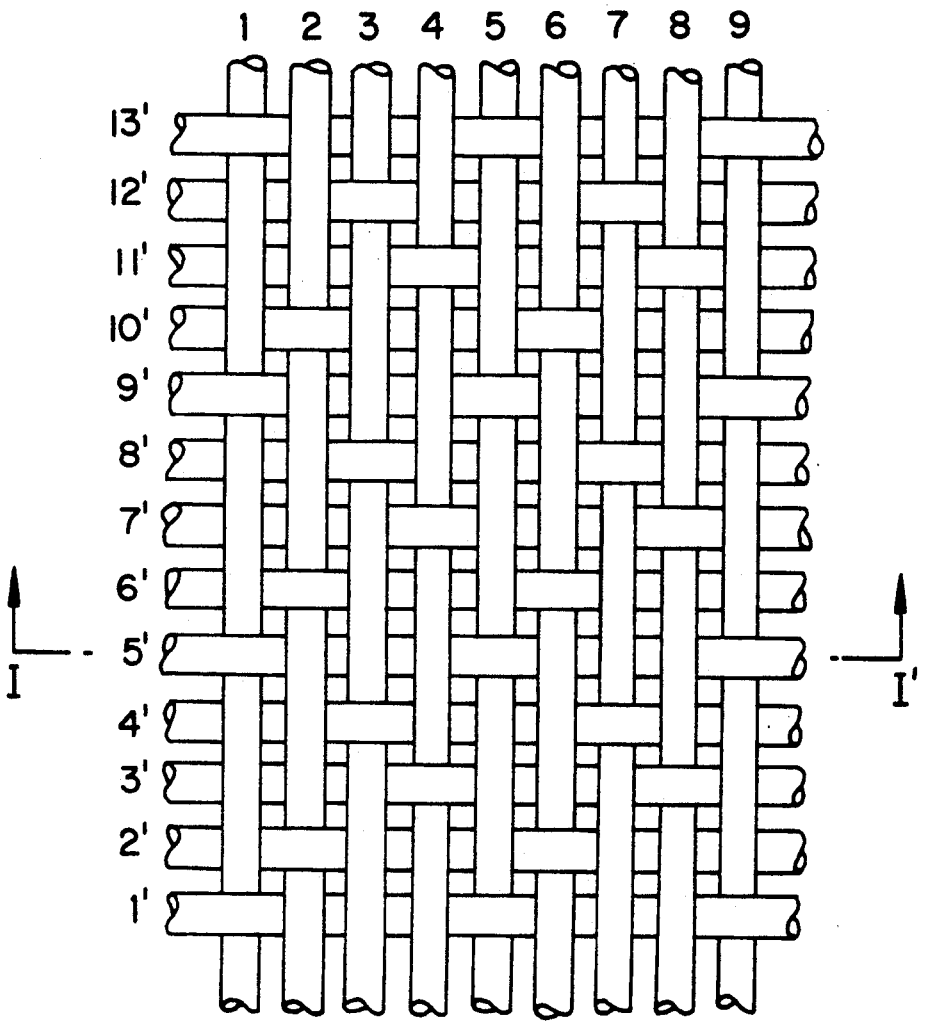
FIG. 1, FIG. 3 and FIG. 5 show the plan views of the fabrics of the present invention.

As described herein, wear-resistant volume is not increased, as described above, merely by increasing the diameter of the weft. The shape of the crimp of the weft extruding over the running side of the paper making fabric is critical for the wear-resistant volume. If the fabric has a structure in which the weft is sufficiently bent, then the crimp of the weft has a rectangular shape in longitudinal cross section of fabric, and thus has a maximum effective wear-resistant volume. The weft itself is of cylindrical cross section. The warp which is not bent is not extended with tensile force and thus is effective for keeping the attitude of the fabric, since the fabric is subjected to an intense tensile force in the warp direction during its use. A fabric is formed by crossing warps and wefts, so that it is important for the fabric to have a structure wherein the warp is not bent, but the weft is sufficiently bent in relation to the warp.

The attitude stability of the fabric for paper making requires it to bear not only the tensile force in the warp direction but also loadings in any directions such as the weft direction or the vertical direction. Since a fabric is formed essentially by crossing warps and wefts and weaving them into a weave, the attitude stability of the whole fabric is substantially improved by fixing both warps and wefts in the state of being sufficiently crossed. That is, if the warps and the wefts can be fixed and unified at the state of being crossed completely with each other by the sufficient bending of the wefts, excellent attitude stability of the fabric can be exhibited like a molded article.

In this connection, none of the known fabrics have met these goals. Ordinary fabrics are required to have such fabric properties as flexibility and soft feel and thus properties such as stretch or softness are necessary for the fabrics. On the other hand, attitude stability is rather shunned in spite of the necessity for it, since flexibility, soft feel or good touch will be lost from a fabric having an excessive attitude stability. Thus, the fabric for paper making is required to have the properties quite different from those of ordinary fabrics and therefore belong to a special field. Therefore, the fact is that no fabrics for paper making which satisfy the aforementioned requirements have been found and no suitable filaments for constructing such fabrics have been found as well.

The present invention has as an object to provide a fabric for paper making which satisfies the aforementioned requirements. It has been found that a fabric for paper making cannot be constructed with a filament which is used for ordinary fabrics and that instead a special filament must be used. Accordingly, an object of the invention is to provide an extendable and heat shrinkable polyester monofilament required for constructing fabrics for paper making, as well as to provide a fabric for paper making having an excellent advantageous effects.

The special filament according to the present invention for forming a paper making fabric in which wefts are sufficiently bent and the whole of which is integrally fixed is an extendable and heat shrinkable polyester monofilament, which is plastically deformed at a loading in the range of 0.5 g/d–2.5 g/d, has an extension in the range of 1–10% at the yield point and a heat shrinkage factor of 7% or more in immersing the monofilament into a boiling water.

The filament is a novel filament which was unknown prior to this invention. Ordinary filaments having no yield point elastically deform gradually and continuously and do not exhibit the behavior such that deformation occurs for the first time on application of a specific loading. On the contrary, the filament for paper making fabrics according to the present invention has a specific yield pint described above, and it is sufficiently bent by the weaving force of a textile weaving loom applied to the weft on weaving, deformed plastically and crossed with the warp, so that the deformation is not released even if the fabric is removed from the loom. Filaments having no yield point are not bent sufficiently by the weaving force of a textile weaving loom applied on weaving. As a result, the deformation which is elastic in nature is released gradually to return the filament to its original configuration when the fabric is removed from the loom. It is important that the extendable and heat shrinkable polyester monofilament according to the present invention deforms plastically and does not return to the original configuration even if loading or force is removed. Therefore, a fabric comprising this filament as a weft is stabilized at a state in which the weft is sufficiently bent during weaving, and thus a fabric very excellent in attitude stability and surface smoothness can be formed.

As the extendable and heat shrinkable polyester monofilament of the present invention has, as described above, an extremely large heat shrinkability, it heat shrinks to a large extent and the weft is heat set in such a state that the weft holds the warp firmly in a sufficiently bent configuration to greatly improve the attitude stability of the fabric. Further, the weft heat shrinks greatly in such a state as the weft is bent sufficiently on weaving, and thus the crimp of the weft has a rectangular shape in longitudinal cross section between the warps to greatly increase its effective wear-resistant volume. While the filament having these characteristics increases the resistance to wear when arranged as the weft on the running surface of a paper making fabric, the monofilament also improves the quality of paper as it makes the face smooth on being arranged on the paper making surface.

The fabric of the present invention includes the so-called single-layer fabric in which the extendable and heat shrinkable polyester monofilament is arranged as a weft in one layer and a multiple weft-layer paper making fabric in which the wefts are arranged in multiple layers. The extendable and heat shrinkable polyester monofilament may be used alone or in combination with other monofilaments. As the other monofilaments, there are mentioned conventional polyester monofilaments, polyamide monofilaments and the like. These conventional monofilaments may be used in such an amount as will not impair the advantageous effect of the special, extendable and heat shrinkable polyester monofilament of the present invention.

The extendable and heat shrinkable polyester monofilament of the present invention may be also arranged as warp or as both the warp and weft.

The monofilament of the present invention must have an extension in the range of 1–10% and a heat shrinkage factor of 7% or more in immersing the monofilament into a boiling water. A filament having an extension of more than 10% at the yield point has problems that the diameter of the filament changes due to the extension on a loom on weaving or the weft does not come out from a bobbin or a tube. On the other hand, filament having an extension of less than 1% does not deform elastically, and thus it cannot form a fabric in which the weft is sufficiently bent. When the monofilament has a heat shrinkage factor of less than 7%, the heat shrinkability is too little to obtain a preferred attitude stability upon being heat set. For instance, while some of the conventional polyester monofilament for paper making fabrics have an extension of up to about 2.5% at a loading of 1 g/d, they do not deform plastically because they have no yield point and have only a heat shrinkage factor in the range of 0.5–2.5% on immersing said monofilament into boiling water.

The effects and properties of the present invention are described herein with reference to the extendable and heat shrinkable polyester monofilament and the paper making fabric.

The extendable and heat shrinkable polyester monofilament of the present invention possesses the properties such as plastic deformability and heat shrinkability and exhibits the effect that the width of the fabric does not shrink on weaving.

In other words, ordinary weft is deformed elastically and bent on weaving. The width of the fabric is kept due to pressing the fabric with a reed. While the fabric elastically recovers and loses the deformation and the width is increased as soon as it is removed from the loom, the warp of the fabric is stretched intensely to bend the weft to a greater extent than on weaving, so that the width shrinks greatly to lose the attitude stability as soon as the fabric is removed from the loom.

As the extendable and heat shrinkable polyester monofilament of the present invention is a soft yarn, it is bent sufficiently and deformed at the state by the force applied on weaving (corresponds to the yield value) and will not return to its original configuration upon removal of the loading. Therefore, the width of the fabric is not decreased when the fabric is removed from the loom, and the attitude is stabilized. Such advantageous effects are particularly preferable in an endless fabric which requires a precise size.

Next, the operation and the advantageous effects are described with reference to the paper making fabric in which arranges the extendable and heat shrinkable polyester monofilament is used as the weft.

The working life of the paper making fabric is increased by increasing the wear-resistant volume of the weft which forms the running surface. Such effect is observed in both a single layer fabric and a double weft-layer fabric. That is, the working life of the fabric is at an end when the warp is worn and broken and the running endless fabric is broken. Therefore, it is necessary to avoid the wear of the warp. Accordingly, resistance to wear is imparted to the weft to achieve the desired result.

In order to increase the wear-resistant volume of the weft which forms the running surface, it may be sufficient that a weft having a large diameter is arranged as the weft. However, such an arrangement has the aforementioned defect and does not satisfactorily increase the effective wear-resistant volume. Also, if the length of the weft crimp, that is, the length of the weft extruding over the running surface between knuckles which are bent by the warps is increased, the wear-resistant volume ought to be increased. However, the present inventors have found that the wear-resistant volume will not always be increased merely by increasing the length.

The present inventors have found that the apparent wear-resistant volume of the weft is very different from the effective wear-resistant volume of the weft and the mere increase of the apparent wear-resistant volume does not influence the wear-resistant effect.

That is, in the weft of the running surface of a practicable fabric, there are portions which have no wear-resistant effect because of the crimp shape at the knuckle parts where warp and weft are crossed and the yarn is sharply bent.

One of the features of the fabric of the present invention resides in an extendable and heat shrinkable polyester monofilament having special properties and arranged as the weft of the running surface. The weft is sufficiently bent and forced over between the warps to increase the length of the weft crimp and to form a crimp having a rectangular shape in longitudinal cross section taken through the fabric. The filament itself has a cross section. The portion of the weft which does not constitute any wear-resistant effect in the overall fabric is thereby decreased and the effective wear-resistant volume is increased extensively.

Another feature of the present invention resides in an extendable and heat shrinkable polyester monofilament having special properties arranged as the weft of the running surface, the weft is sufficiently bent at the knuckle parts and in a deformed state, so that the weft holds the warp and, when heat set, the knuckle parts are fixed and the attitude stability is greatly improved.

A further feature of the present invention resides in an extendable and heat shrinkable polyester monofilament having special properties being arranged as the weft of the running surface, the weft is sufficiently bent at the knuckle parts and in a deformed state to hold the warp, so that the running surface of the fabric has a smooth surface and contacts uniformly with the foil of a paper making machine to improve the drainage property. Furthermore, the fabric has a good holding ability to a guide roll and thus the guiding property is improved. The effect of improving the guiding property is common to all endless fabrics.

Another feature of the present invention resides in the arrangement of the aforementioned weft on the paper making surface of the fabric thereby making the surface smooth and improving the quality of paper, supporting ability for pulp fiber and wire-marking property.

The other important feature of the fabric of the present invention resides in the feature of edge curling of the paper making fabric. The most popular multiple-layer fabric for paper making at present comprise a relatively rigid yarn as the upper-layer weft to reduce deforming and to level the crimp with the warp. Thus, the upper-layer weft has a large heat shrinkage factor. On the other hand, the lower-layer weft is sufficiently bent and a long crimp is formed to increase the wear-resistant property so that the warp is prevented from contacting the paper making surface and from wear. That is, the weft in the lower-layer has a small heat shrinkage factor.

As the conventional fabric has such a structure as described above, during the heat setting process the weft in the upper-layer having a large heat shrinkage factor is subjected to a shrinking force in the width direction and the lower weave is subjected to a force extending in the width direction, so that the edge curling of the fabric occurred. Accordingly, when the extendable and heat shrinkable monofilament of the present invention is used as the lower weft, it has good crimping ability and a large shrinkage factor, the lower-layer weft is subjected to a shrinking force in the width direction at least in the same level as the upper-layer, and thus the edge curling of the fabric does not occur. If the edge curling occurred, not only does the fabric shrink in the width direction, but also the running position becomes hard to control.

The paper making fabric cf the present invention includes also a single-layer fabric comprising a single weft layer as well as the multiple layered fabrics such as double or triple weft-layer fabrics. In the case of the multiple weft-layer fabric in which the wefts are arranged in the vertical multiple layers, i.e., the paper making surface and the running surface, as is understood from the above described features, yarns suitable for the structures of respective surface can be arranged for the respective wefts. The extendable and heat shrinkable polyester monofilament of the present invention therefore exhibits the desired effect most clearly and the multiple layered paper making fabric which is very excellent in the improvement and the resistance to wear can be provided.

While the fabric for paper making of the present invention is woven with use of a weft of the aforementioned special, extendable and heat shrinkable polyester monofilament, the shrunk weft is fixed firmly and will not be extended or deformed if the fabric is once finished with heat setting after weaving.

The increase of the wear-resistant volume and the increase of the resistance to wear will be further described specifically in the detailed description of the preferred embodiments with comparative examples cf conventional fabrics.

The embodiments of the present invention are described with reference to the drawings, and then the comparative tests are also illustrated to explain the advantageous effect of the present invention.

In each drawing, the warps are represented by numerals such as 1, 2 or 3, the upper wefts are represented by numerals with prime such as 1', 2' or 3', and the lower wefts are represented by numerals with double prime such as 1'', 2'' or 3''.

FIG. 1 is a plan view illustrating a part of the single woven fabric for paper making in which the extendable and heat shrinkable monofilament of the present invention is arranged as the weft.

Figure 2:
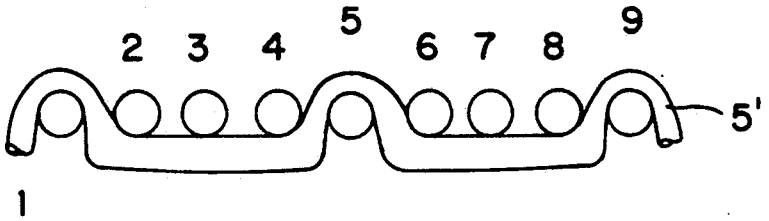
FIG. 2, FIG. 4 and FIG. 6 show the cross sectional views of the fabrics shown in FIG. 1, FIG. 3 and FIG. 5, respectively.

FIG. 2 is a sectional view taken along the line I–I' of FIG. 1, in which a weft 5' is woven with warps 1, 5 and 9 and passes under warps 2, 3, 4, 6, 7 and 8 to form crimps for three warps. As the weft 5' is an extendable and heat shrinkable polyester monofilament having a specific yield point, a plastic deformability and a large heat shrinkability, it is bent sufficiently and deformed plastically on weaving and it further shrinks intensely to form a crimp extruding from the lower face between the warps 1 and 5, which crimp exhibits the wearing effect. It is understood that the weft is bent sufficiently and set and that the weft holds the warps firmly and the warps are not exposed on the running surface. The weft 5' is bent almost vertically at the both sides of the warps 1, 5 and 9 by the plastic deformation effect and the heat shrinking effect, and the crimp of the weft has a rectangular shape in longitudinal cross section. The weft has a cylindrical cross sectional shape. As is clear from the rectangular shape of the crimp in longitudinal cross section, the wear-resistant volume is maximum. It is also clear that the lower face of the crimp is flat and the running surface is smooth.

Figure 3:
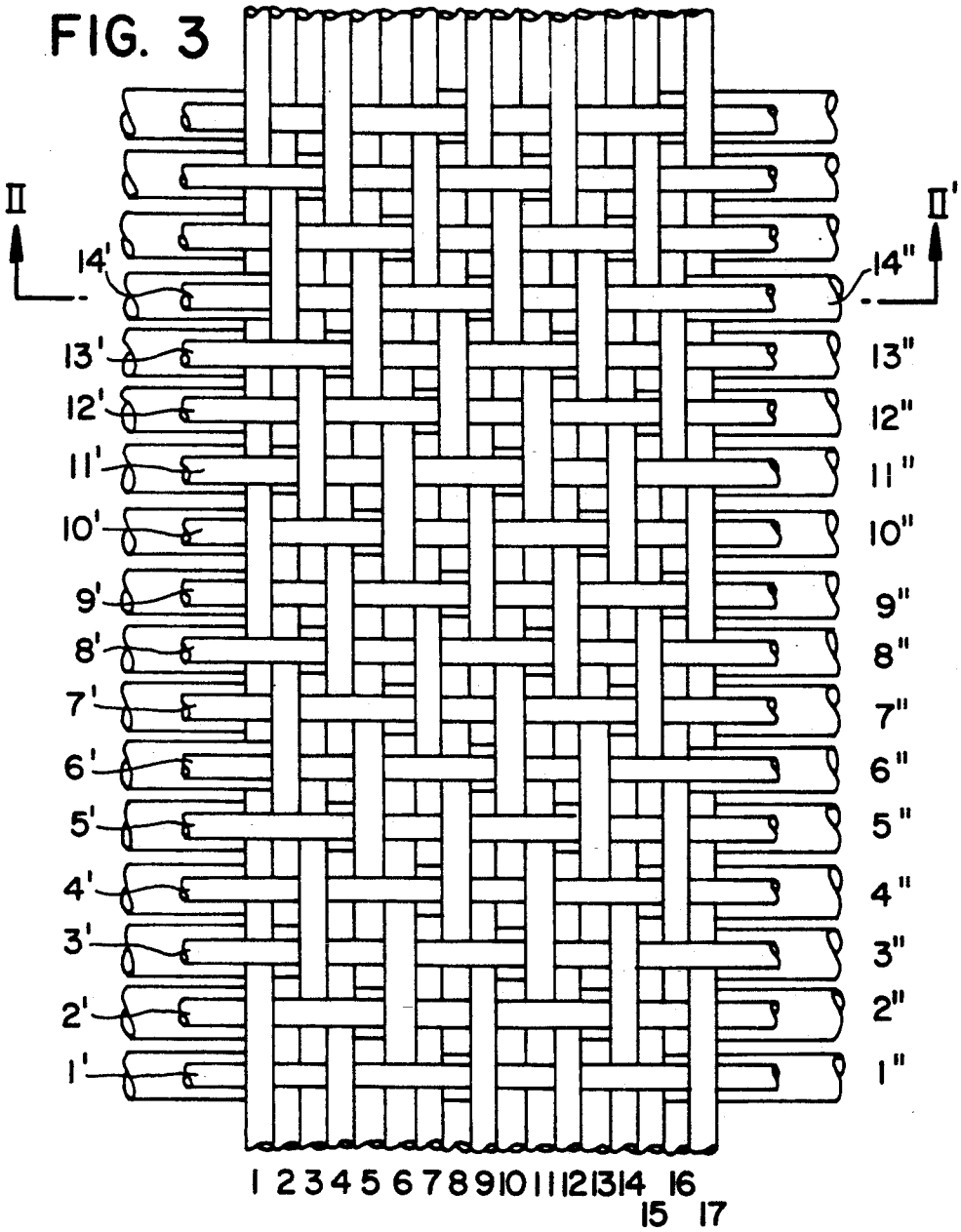

The embodiment in FIG. 3 shows a plan view illustrating a part of a double-layer fabric in which the extendable and heat shrinkable monofilament of the present invention is arranged as the lower weft.

Figure 4:
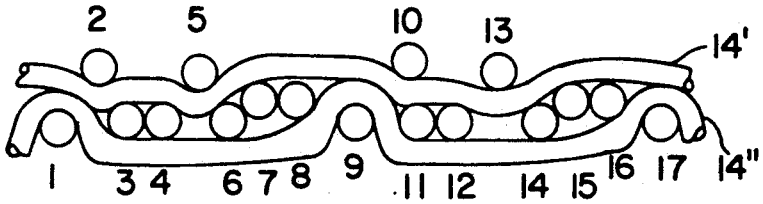

FIG. 4 is a sectional view taken along the line II–II' of the fabric shown in FIG. 3. In this embodiment, while the extendable and heat shrinkable monofilament of the present invention is arranged as the lower-layer weft, a conventional polyester monofilament is arranged as the weft in the upper-layer. The lower-layer weft 14'' is woven with warps 1, 9 and 17 and passes under warps 2–8 and 10–16 to form a crimp for seven warps. The lower-layer weft 14'' is bent sufficiently and subjected to plastic deformation and it further shrinks intensely during the heat setting process, so that the crimp has a shape extending largely from the lower face between the warps 1 and 5. The crimp exhibits the wearing effect.

Also in this embodiment, the lower-layer weft is bent sufficiently and fixed in the same manner as the weft of the embodiment in FIG. 1, and thus it is understood that the weft holds the warps firmly and the warps are not exposed on the running surface. The weft 14'' is bent almost vertically at the both sides of the warps 1, 9 and 17 by the plastic deformation effect and the heat shrinking effect, and the crimp of the weft has a rectangular shape in longitudinal cross section. The weft is of cylindrical shape in cross section. As is understood from this shape, the wear-resistant volume is maximum. It is also clear that the lower surface of the crimp is flat and the running surface smooth. On the other hand, the upper-layer weft 14' comprises a conventional polyester monofilament, and the crimp has a shape of a circular arc but not a rectangular shape in longitudinal cross section different from the shape of the lower weft with no flat upper surface or no smooth fabric surface.

Furthermore, as the upper surface of the crimp is lower than the warps, the weft is subject to have a shape that the weft sinks down between the two warps and paper pulp tends to accumulate at the recess to form at mat. Although the fabric is excellent in resistance to wear and attitude stability, it is risky in causing wire marks like conventional fabrics.

Figure 5:
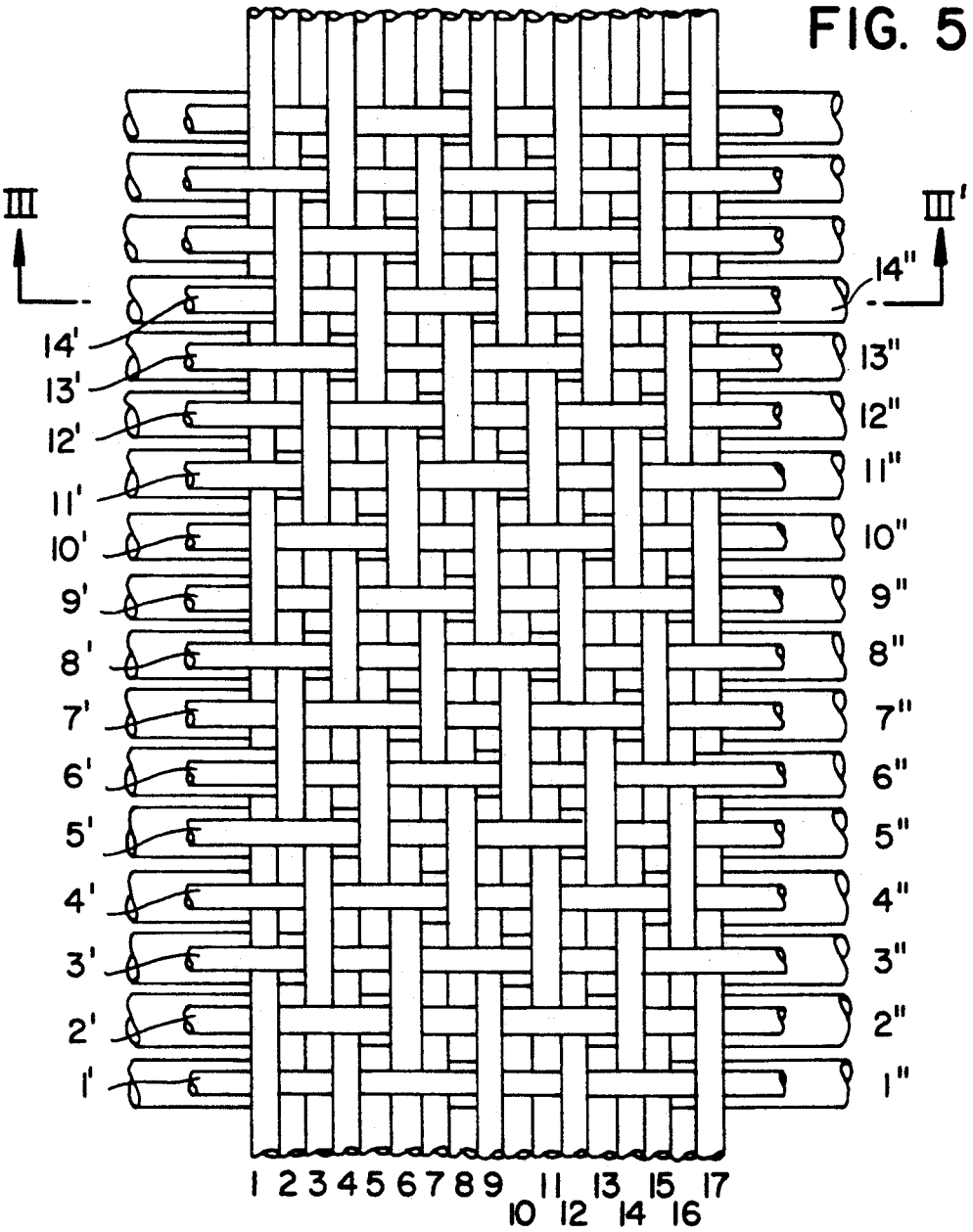

The embodiment in FIG. 5 is a plan view illustrating a part of the double-layer fabric for paper making in which the extendable and heat shrinkable monofilament of the present invention is arranged as both the upper-layer weft and the lower-layer weft.

Figure 6:
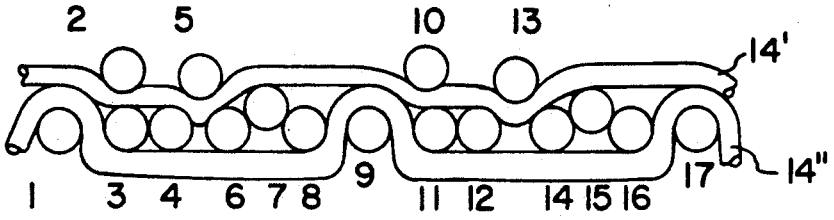

FIG. 6 is a sectional view which shows the section taken along the line III–III' of the fabric shown in FIG. 5. The fabric in this embodiment is the same fabric as that shown in FIG. 3 except that the fabric has an upper-layer weft different from that of the fabric shown in FIG. 3 and thus has a different paper making surface structure. In this embodiment, the extendable and heat shrinkable polyester monofilament of the present invention which has a specific yield point, a plastic deformability and a large heat shrinkability is arranged as both the upper and lower wefts. The lower-layer weft 14'' is woven by warps 1, 9 and 17 and passes under warps 2–8 and 10–16 to form a crimp for seven warps. The lower-layer weft 14'' is bent sufficiently and plastically deformed and it further shrinks intensely during the heat setting process, so that the crimp extrudes largely from the lower face between the warps 1 and 5 and has a rectangular shape in longitudinal cross section. The crimp exhibits the wearing effect.

Also in this embodiment, the lower-layer weft is bent sufficiently and fixed in the same manner as the weft of the embodiment in FIG. 1, and thus it will be understood that the weft holds the warps firmly and the warps are not exposed on the surface of the running surface.

The weft 14'' is bent almost vertically at the both sides of the warps 1, 9 and 17 by the plastic deformation effect and the heat shrinking effect, and the crimp of the weft has a rectangular shape in longitudinal cross section. The weft has a cylindrical cross section. As will be clearly understood from this shape, the wear-resistant volume is maximum. Likewise, the lower surface of the crimp is flat and the running surface is smooth. On the other hand, the upper-layer weft 14' is woven into the weave by the warps 2 and 5 and passes over the warps 3 and 4 to form a crimp for two warps extruding from the lower face. In the same manner, a crimp for two warps between the warps 10 and 13 is formed as well. A crimp for four warps which extrudes from the upper surface is also formed by the weft passing over warps 6, 7, 8 and 9 between the warps 5 and 10. The upper-layer weft yarn 14" comprises the extendable and heat shrinkable polyester monofilament of the present invention, so that the crimp has a rectangular shape in longitudinal section and a flat upper surface in the same manner as the lower-layer weft by the plastic deformation effect and the heat shrinking effect.

Moreover, the crimp, which is formed largely between the warps, has the same level as the warps, and the weft does not have a shape of sinking down between the warps, so that no recess is formed between the warps. Thus, the accumulation of paper pulp or the formation of pulp mat are not observed, and thus wire marks are not generated.

Figure 7:
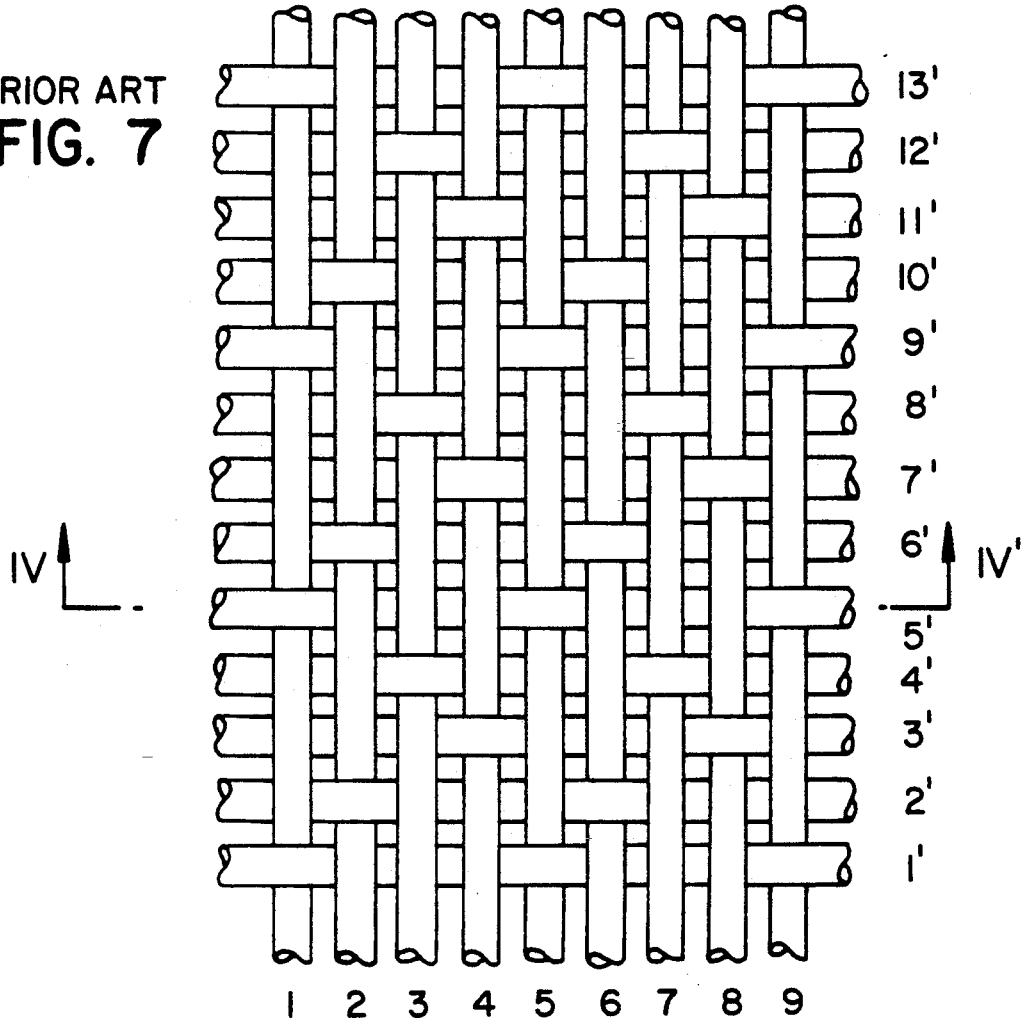
PRIOR ART FIG. 7
FIG. 7 and FIG. 9 show the plan views of the fabrics of the prior art fabrics.

FIG. 7 is a plan view illustrating a part of a conventional prior art fabric for paper making. The filament used is an ordinary polyester monofilament.

Figure 8:
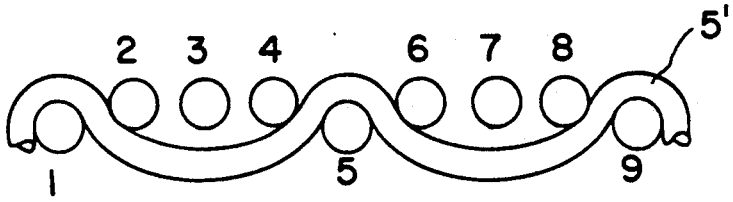
PRIOR ART FIG. 8
FIG. 8 and FIG. 10 show cross sectional views of the prior art fabrics shown in FIG. 7 and FIG. 9, respectively.

FIG. 8 is a sectional view taken along the line IV–IV' of the fabric shown in FIG. 7. The weft 5' is woven by warps 1, 5 and 9 and passes under warps 2, 3 and 4 to form a crimp extruding downwards. However, the crimp is formed not by the plastic deformation but by the elastic deformation of the monofilament which is different from the monofilament of the present invention and has a small heat shrinkability, so that the former monofilament deforms only gradually and forms a crimp in the shape of circular arc which extrudes downwards. It does not form a crimp which is bent almost vertically at both sides of the warps having the weft woven and has the rectangular shape in longitudinal cross section. As is understood from the figure, wear initiates at the arcuate protrusion of the crimp and the weft at both sides of the warps having the weft woven exhibits nc wearing effect and has a very small wear-resistant volume as compared with the crimp having a rectangular shape in longitudinal cross section of the fabric of the present invention.

Figure 9:
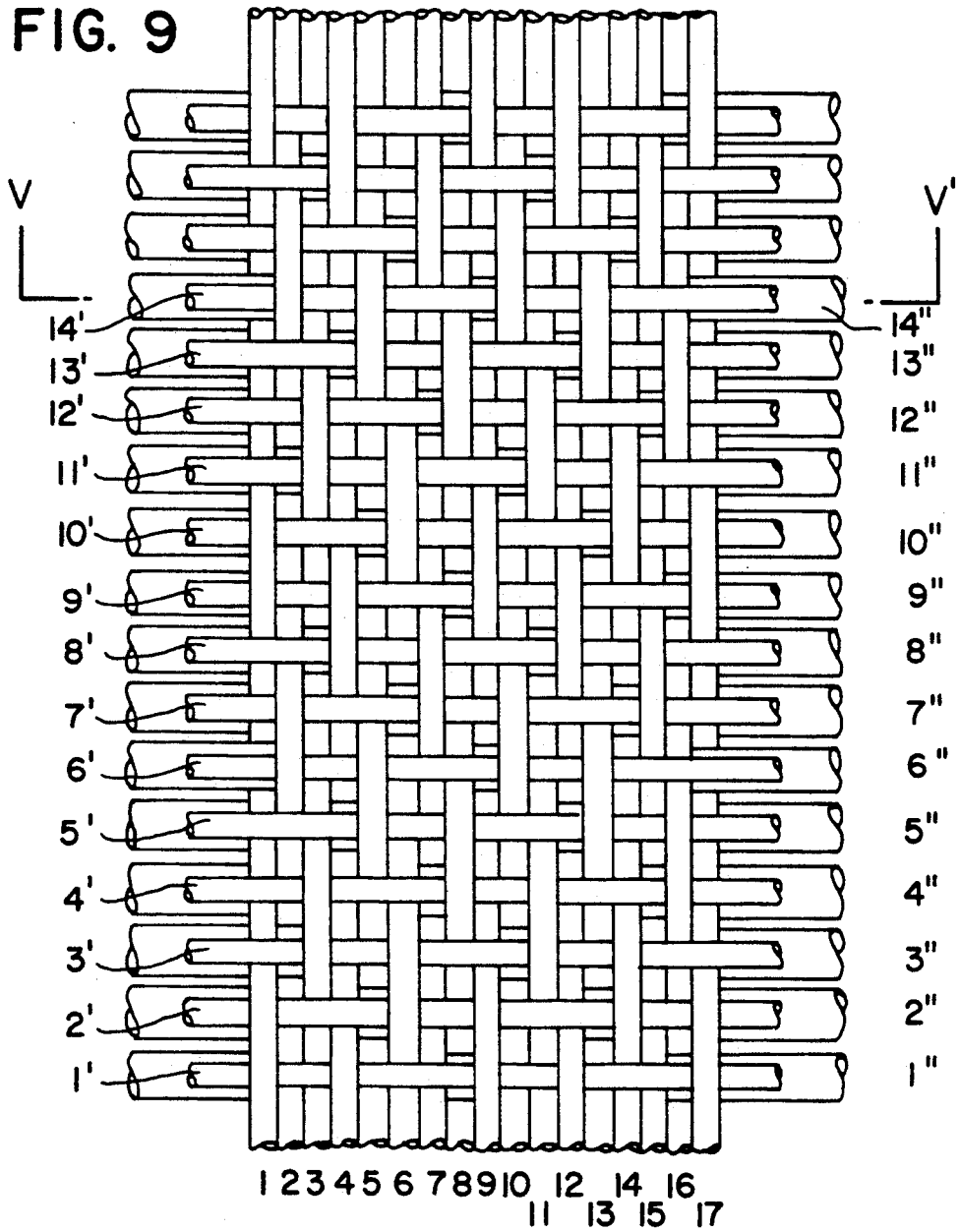
PRIOR ART FIG. 9

FIG. 9 is a plan view of a part of a conventional prior art double layer fabric for paper making. The filament used is an ordinary polyester monofilament.

Figure 10:
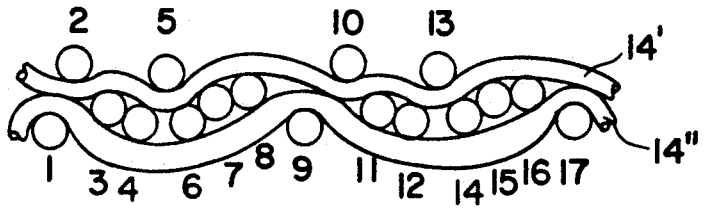
PRIOR ART FIG. 10

FIG. 10 is a sectional view taken along the line V–V' of the fabric shown in FIG. 9. The lower-layer weft 14" is woven by warps 1, 9 and 17 and passes under warps 2–8 and 10–16 to form a crimp for seven warps. However, the crimp is formed not by the plastic deformation but by the elastic deformation of the monofilament which is different from the monofilament of the present invention and has a small heat shrinkability, so that the former monofilament deforms only gradually and forms a crimp in the shape of circular arc which protrudes downwards. It does not form a crimp which has such a rectangular shape in longitudinal cross section as in the paper making fabric of the present invention.

As will be understood from the figures, wear initiates from the arcuate protrusion of the crimp and the weft at both sides of the warps having the weft woven exhibits no wearing effect and has a very small wear-resistant volume as compared with the crimp having a rectangular shape in longitudinal cross section of the fabric of the present invention.

On the other hand, the upper-layer weft 14' comprises a conventional polyester monofilament like the lower-layer 14". Therefore, the monofilament, different from the one of the present invention, deforms only elastically but not plastically and has a small heat shrinkability, so that the former monofilament deforms only gradually and forms a crimp in the shape of circular arc which protrudes upwards. It does not have a crimp which has a rectangular shape in longitudinal cross section as does the paper making fabric of the present invention. It is also found that the upper surface is not flat and the surface of the fabric is not smooth.

Furthermore, as the upper surface of the crimp is lower than the warps, the weft is subject to having a shape such that the weft sinks down between the two warps. Thus, pulp tends to accumulate at the recess to form a pulp mat and generate a wire mark.

As described above, the present invention has been typically described with paper making fabrics as endless fabrics which require the most demanding properties. The endless fabrics have arranged therein the extendable and heat shrinkable polyester monofilament to form a fabric both the upper surface and the lower surface of which are flat. On the lower surface, a crimp having an extremely large wear-resistant volume is formed, and resistance to wear is improved and the fabric is firmly held at such a state as the weft is sufficiently bent to be entwined with the warp thoroughly. Thus, the attitude stability is also improved extensively.

The advantageous effect of the present invention is specifically described below with reference to the comparison test of the conventional endless fabric and the one according to the present invention.

EFFECT COMPARISON TEST

Example 1

A conventional polyester monofilament having a diameter of 0.17 mm was used as a warp, the polyester monofilament of the present invention having a diameter of 0.17 mm and a heat shrinkage factor of 10% on immersing the monofilament into boiling water was arranged as an upper weft, and the polyester monofilament of the present invention having a diameter of 0.22 mm, which deformed plastically at a loading of 1.2 g/d and had an extension of 4.0% at the yield point and a heat shrinkage factor of 13% on immersing the monofilament into boiling water and a conventional polyamide monofilament yarn (Nylon 6) having a diameter of 0.22 mm were alternately arranged as the lower wefts. These yarns were woven to prepare an eight shaft weft double-layer fabric shown in FIGS. 5 and 6, which was subjected to heat setting to give Sample 1 yarn density shown in Table 1. The properties such as yarn density are shown in Table 1.

In comparison, the same warp as that in the aforementioned fabric was used, an ordinary yarn of a polyester monofilament having the same diameter as above was arranged as an upper weft, and an ordinary polyester monofilament having the same diameter as above and an ordinary polyamide (Nylon 6) monofilament were alternately arranged as lower wefts, and these yarns were woven to prepare an eight shaft weft double-layer fabric, which was heat set to give a conventional example 1. The textile design and configuration of the conventional example 1 are shown in FIGS. 9 and 10. The yarn density is shown in Table 1. Test results of these two fabrics are shown in Table 1.

TABLE 1

| | | Sample 1 | Conventional Example 1 |
|---|---|---|---|
| Warp density | (No of yarns/inch) | 155 | 155 |
| Upper weft density | (No. of yarns/inch) | 58 | 58 |
| Lower weft density | (No. of yarns/inch) | 58 | 58 |
| Sheet smoothness*1 | (second) | 92 | 77 |
| Wear-resistant volume on running surface*2 | (mm/inch$^2$) | 24 | 16 |
| Edge curling amount*3 | (mm) | 0 | 9 |
| Lifetime Ratio*4 | | 135 | 100 |

[Notes]
*1Sheet smoothness: A paper sheet having a real weight corresponding to 70 g/m$^2$ was prepared from a raw material pulp incorporated with a mechanical paper with the TAPPI standard sheet test machine, and a smooth sheet was produced by the usual method to determine the smoothness of the paper surface in contact with the fabric surface by the Bekk smoothness tester.
*2Wear-resistant volume on running surface: Volume of the warp and the weft in which the sectional area of the warp on the running surface amounts to 50% of the sectional area of the fabric.
*3Edge curling amount: Variation of the height from the level part to the edge part of the fabric when a fabric was made endless, set on two rolls with a tension of 12 kg/cm and dipped into water.
*4Lifetime Ratio: Measurement was conducted with ground calcium carbonate as a filler by a wear tester (manufactured by NIPPON FILCON K. K.; Registered Utility Model No. 1350124).

Example 2

A conventional polyester monofilament yarn having a diameter of 0.20 mm was used as a warp, a conventional polyester monofilament yarn having a diameter of 0.19 mm was used as a upper weft, and the polyester monofilament of the present invention having a diameter of 0.22 mm, which deformed plastically at a loading of 1.2 g/d and had an extension of 4.0% at the yield point and a heat shrinkage factor of 13% on immersing the monofilament into boiling water was used as a lower weft. These yarns were woven to prepare an eight shaft weft double-layer fabric shown in FIGS. 3 and 4, which was subjected to heat setting to give Sample 2 as an example of the present invention having the yarn density shown in Table 2.

The properties such as the yarn density are shown in Table 2.

In comparison, the same warp and upper weft as those in the aforementioned fabric were used and an ordinary yarn of a polyester monofilament having the same diameter as above was arranged, and these yarns were woven into a fabric of an eight shaft weft double-layer weave, which was heat set to give a conventional example 2. The textile design and configuration of the conventional example are shown in FIGS. 9 and 10, and the yarn density and the other properties are also shown in Table 2. The test results of these two fabrics are also shown in Table 2.

TABLE 2

| | | Sample 2 | Convention Example 2 |
|---|---|---|---|
| Warp density | (No. of yarns/inch) | 148 | 148 |
| Upper weft density | (No. of yarns/inch) | 50 | 50 |
| Lower weft density | (No. of yarns/inch) | 50 | 50 |
| Sheet smoothness*1 | (second) | 75 | 70 |
| Wear-resistant volume on running surface*2 | (mm/inch$^2$) | 26 | 13 |
| Edge curling amount*3 | (mm) | 0 | 5 |
| Lifetime Ratio*4 | | 170 | 100 |

[Notes]
*1Sheet smoothness: A paper sheet having real weight corresponding to 70 g/m$^2$ was prepared from a raw material pulp incorporated with a mechanical paper with the TAPPI standard sheet test machine, and a smooth sheet was produced by the usual method to determine the smoothness of the paper surface in contact with the fabric surface by the Bekk smoothness tester.
*2Wear-resistant volume on running surface: Volume of the warp and the weft in which the sectional area of the warp on the running surface amounts to 50% of the sectional area of the fabric.
*3Edge curling amount: Variation of the height from the level part to the edge part of the fabric when a fabric was made endless, set on two rolls with a tension of 12 kg/cm and dipped into water.
*4Limetime Ratio: Measurement was conducted with ground calcium carbonate as a filler by a wear tester (manufactured by NIPPON FILCON K. K.; Registered Utility Model No. 1350124).

Example 3

A conventional polyester monofilament yarn having a diameter of 0.25 mm was used as a warp, and the polyester monofilament of the present invention having a diameter of 0.3 mm, which deformed plastically at a loading of 1.7 g/d and had an extension of 2.3% at the yield point and a heat shrinkage factor of 17% immersing the monofilament into boiling water was used as a weft. These yarns were woven to prepare a fabric of a four shaft 3/1 broken twill shown in FIGS. 1 and 2, which was subjected to heat setting to give Sample 3 as an example of the present invention.

The yarn density and other properties are shown in Table 3.

In comparison, the same warp as those in the aforementioned fabric was used an<an ordinary yarn of a polyester monofilament having the same diameter as above was arranged as a weft. These yarns were woven into a fabric of a four shaft 3/1 broken twill, which was heat set to give a conventional example shown in FIGS. 7 and 8. The yarn density and other properties are shown in Table 3. Test results of these two fabrics are shown in Table 3.

TABLE 3

| | | Sample 3 | Conventional Example 3 |
|---|---|---|---|
| Warp density | (No. of yarns/inch) | 56 | 56 |
| Weft density | (No. of yarns/inch) | 45 | 45 |
| Sheet smoothness*1 | (second) | 67 | 63 |
| Wear-resistant volume on running surface*2 | (mm/inch$^2$) | 46 | 35 |
| Edge curling amount*3 | (mm) | 0 | 6 |
| Lifetime Ratio*4 | | 122 | 100 |

[Notes]
*1Sheet smoothness: A paper sheet having a real weight corresponding to 70 g/m$^2$ was prepared from a raw material pulp incorporated with a mechanical paper with the TAPPI standard sheet test machine, and a smooth sheet was produced by the usual method to determine the smoothness of the paper surface in contact with the fabric surface by the Bekk smoothness tester.
*2Wear-resistant volume on running surface: Volume of the warp and the weft in which the sectional area of the warp on the running surface amounts to 50% of the sectional area of the fabric.
*3Edge curling amount: Variation of the height from the level part to the edge part of the fabric when a fabric was made endless, set on two rolls with a tension of 12 kg/cm and dipped into water.
*4Lifetime Ratio: Measurement was conducted with ground calcium carbonate as a filler by a wear tester (manufactured by NIPPON FILCON K. K.; Registered Utility Model No. 1350124).

As is apparent from Examples described above, the fabric of the present invention, as compared with that of the conventional example, has excellent smoothness of the fabric surface, exhibits no edge curling, shows excellent running ability, and has extensively improved working life by the increase of the wear-resistant volume on the running surface.

We claim:

1. An extendable and heat shrinkable polyester monofilament suitable for producing an endless fabric which deforms plastically in the loading range of 0.5 g/d–2.5 g/d and has an extension at the yield point in the range of 1–10%.

2. The extendable and heat shrinkable polyester monofilament according to claim 1 which deforms plastically in the loading range of 0.5 g/d–2.5 g/d on applying a load at a rate of 2 mm/min.

3. The extendable and heat shrinkable polyester monofilament according to claim 1 which further exhibits a heat shrinkage factor of 7% or more on immersing said monofilament into boiling water.

4. An extendable and heat shrinkable polyester monofilament suitable for producing an endless fabric which deforms plastically in the loading range of 0.5 g/d–2.5 g/d on applying a load at a rate of 2 mm/min and has an extension in the range of 1–10% at the yield point and a heat shrinkage factor of 7% or more on immersing the monofilament into boiling water.

5. An endless fabric, comprising a plurality of warps and wefts and wherein the extendable heat shrinkable polyester monofilament according to claim 1 is arranged at least as a weft.

6. A wear-resistant paper making fabric comprising a plurality of warps and wefts and wherein the extendable heat shrinkable polyester monofilament according to claim 1 is arranged at least as a weft.

7. A wear-resistant paper making fabric comprising a plurality of warps and wefts and wherein the extendable heat shrinkable polyester monofilament according to claim 4 is arranged at least as a weft.

8. An endless multiple weft-layer fabric having wefts arranged in multiple layers of upper and lower layers, wherein the extendable heat shrinkable polyester monofilament according to claim 1 is arranged at least as a weft of said endless multiple weft-layer fabric.

9. A wear-resistant multiple weft-layer fabric for paper making having wefts arranged in the multiple layers of the upper paper making surface and the lower running surface, wherein the extendable heat shrinkable polyester monofilament according to claim 1 is arranged at least as a weft of the fabric.

10. A wear-resistant multiple weft-layer fabric according to claim 9 wherein the extendable heat shrinkable polyester monofilament is arranged at least as a weft on the running surface of the fabric.

11. A wear-resistant multiple weft-layer fabric for paper making having wefts arranged in the multiple layers of the upper paper making surface and the lower running surface, wherein a combination of a conventional polyester monofilament and/or a polyamide monofilament and the extendable and heat shrinkable polyester monofilament according to claim 1 is arranged at least as a weft of the fabric.

12. A wear-resistant multiple weft-layer fabric according to claim 11 wherein the heat shrinkable polyester monofilament is arranged at least as a weft on the running surface of the fabric.

* * * * *